US008960276B2

(12) United States Patent
Lang et al.

(10) Patent No.: US 8,960,276 B2
(45) Date of Patent: Feb. 24, 2015

(54) WELLHEAD SEAL DEVICE TO SEAL CASING

(75) Inventors: Heinrich Lang, The Woodlands, TX (US); Tony M. Lam, Edmonton (CA); Tianle Guo, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 547 days.

(21) Appl. No.: 13/238,449

(22) Filed: Sep. 21, 2011

(65) Prior Publication Data

US 2012/0067597 A1 Mar. 22, 2012

Related U.S. Application Data

(60) Provisional application No. 61/385,299, filed on Sep. 22, 2010.

(51) Int. Cl.
*E21B 33/04* (2006.01)
*E21B 33/03* (2006.01)
*E21B 33/12* (2006.01)

(52) U.S. Cl.
CPC ..... *E21B 33/04* (2013.01); *E21B 33/12* (2013.01)
USPC ..... 166/85.3; 166/75.14; 166/96.1; 277/328; 285/123.14

(58) Field of Classification Search
CPC ..... E21B 33/04
USPC ..... 166/85.3, 75.14, 96.1; 285/123.7, 285/123.8, 123.11, 123.14; 277/328
See application file for complete search history.

(56) References Cited

U.S. PATENT DOCUMENTS

| | | | | | |
|---|---|---|---|---|---|
| 1,297,562 | A | * | 3/1919 | Haney | 285/374 |
| 1,579,648 | A | * | 4/1926 | Crickmer | 285/123.8 |
| 1,786,407 | A | * | 12/1930 | Humason | 285/123.7 |
| 2,417,181 | A | * | 3/1947 | Sandilands | 285/123.7 |
| 2,683,046 | A | * | 7/1954 | Allen | 285/123.8 |
| 2,689,139 | A | * | 9/1954 | Jones et al. | 285/123.8 |
| 3,038,745 | A | * | 6/1962 | Cooke, Jr. | 285/123.8 |
| 3,994,517 | A | * | 11/1976 | Carmichael et al. | 285/123.8 |
| 4,390,186 | A | | 6/1983 | McGee et al. | |
| 4,407,514 | A | * | 10/1983 | Hausler | 277/322 |
| 4,646,845 | A | | 3/1987 | Boeker | |
| 4,718,679 | A | | 1/1988 | Vyvial | |
| 4,771,832 | A | | 9/1988 | Bridges | |
| 4,790,379 | A | * | 12/1988 | Vanderford, Jr. | 166/208 |
| 4,911,245 | A | | 3/1990 | Adamek et al. | |
| 5,031,695 | A | * | 7/1991 | Cain et al. | 166/75.14 |
| 5,135,266 | A | | 8/1992 | Bridges et al. | |
| 5,158,326 | A | | 10/1992 | Anderson et al. | |

(Continued)

*Primary Examiner* — Kenneth L Thompson
(74) *Attorney, Agent, or Firm* — Lathrop & Gage LLP

(57) ABSTRACT

A wellhead seal device forms metal seals in an annular space between inner and outer tubular members such as a rough casing held within aligned casing and tubing heads. An annular metal sealing sleeve has a lower portion seated in the annular space, and an upper portion which forms an inner sealing annulus adjacent the outer wall of the inner tubular member. A metal seal ring and a wedge ring are located in the inner sealing annulus. A retaining ring is retained by the upper portion above the wedge ring. Threaded seal energizing members extend through the retaining ring to push downwardly on the wedge ring and compress the metal seal ring radially inwardly to form a metal seal to the inner tubular member and thus seal the inner sealing annulus. The lower portion of the annular metal sealing sleeve may seal to the casing head and to the casing.

24 Claims, 3 Drawing Sheets

(56) References Cited

U.S. PATENT DOCUMENTS

| | | | | |
|---|---|---|---|---|
| 5,183,268 | A | | 2/1993 | Wong et al. |
| 5,257,792 | A | | 11/1993 | Putch et al. |
| 5,342,066 | A | * | 8/1994 | Henley et al. ..... 277/329 |
| 5,464,063 | A | | 11/1995 | Boehm, Jr. |
| 7,111,688 | B2 | | 9/2006 | vanBilderbeek |
| 7,950,466 | B2 | | 5/2011 | Rodgers et al. |

* cited by examiner

WELLHEAD SEAL DEVICE TO SEAL CASING

CROSS-REFERENCE TO RELATED APPLICATION

This application claims priority from U.S. Provisional Patent Application No. 61/385,299 filed Sep. 22, 2010, which is incorporated by reference herein to the extent that there is no inconsistency with the present disclosure.

FIELD OF THE INVENTION

This invention relates to a wellhead seal device for sealing an annular space between tubular members, for example for sealing the annular space formed in a central bore of vertically aligned upper and lower wellhead members adjacent the rough outer wall of a tubular casing extending through the lower wellhead member and ending in the upper wellhead member. The invention also relates to a wellhead assembly sealed with the wellhead seal device, and to a method of sealing a wellhead with the wellhead seal device.

BACKGROUND

A tubular casing string, termed "casing" is used when drilling wells to support the drill hole against collapse. Casing is hung with a casing hanger, or is otherwise supported such as with a casing slip assembly, within the central bore of a pressure-containing wellhead member called a casing head. A "primary seal" is formed between the casing head and the rough outer wall of the casing to prevent fluid flow between the outside of the casing and the casing head. The casing may extend upwardly from the casing head to a cut upper end, which is then contained within a pressure-containing wellhead member called a tubing head. The casing and tubing heads are connected at mating surfaces in a pressure tight connection. A string of production tubing is supported by the tubing head, to extend concentrically within the casing. The production tubing acts as a conduit for the oil, gas or water of the well. To seal the contents of the well from the primary seal between the casing and the casing head, one or more additional seals are used above the primary seal, between the tubing head and the casing. These one or more additional seals are termed "secondary seals".

Metal seals are favoured to provide an extreme temperature, high pressure metal-to-metal barrier seal between metal surfaces in wellhead environments. When the metal sealing surfaces are machine finished surfaces, a large number of metal-to-metal seal designs may be used, such as an interference fit between tapered, machined metal surfaces. However, when the metal seal is to an un-machined or otherwise rough outer surface of a casing, it is more difficult to make a metal seal. The following patents show exemplary secondary seals to a rough casing: U.S. Pat. No. 4,646,845 to Boeker; U.S. Pat. No. 4,718,679 to Vyvial; U.S. Pat. No. 4,771,832 to Bridges; U.S. Pat. No. 4,911,245 to Adamek et al.; U.S. Pat. No. 5,158,326 to Anderson et al. and U.S. Pat. No. 5,183,268 to Wong et al.

Most metal seals to a rough casing have been made in wellheads in which considerable pressure may be exerted to energize the metal seal through the use of flanged connections between the wellhead members. However, for threaded unions between wellhead members, metal seals are more difficult to achieve, since the limited force which is applied to make the threaded connection may not be sufficient to energize the seal. In a threaded union, the wellhead members are held together by a threaded nut or collar that is tightened to a required torque using a wrench or a hammer. One exemplary threaded union is shown in U.S. Pat. No. Publication 2008/0185156 to Rodgers et al., in which a threaded collar between a tubing head and a casing head includes a set of left-hand threads and a set of right-hand threads to connect to the outer threads on the tubing and casing heads.

Thus, one disadvantage of most prior-art threaded unions is that they rely on elastomeric seals, and not metal seals, to achieve a pressure containing, fluid-tight joint between wellhead members. However, flanged connections between wellhead members are expensive to construct and time-consuming to assemble in the field. As the oil industry continues to move toward producing hydrocarbons at a lower cost, there is considerable interest in wellhead equipment that can be quickly assembled and disassembled. Threaded unions are much quicker and less expensive than flange connections to construct. However, reliable high-pressure metal-to-metal seals with a threaded unions continues to be a problem area for the industry.

SUMMARY OF THE INVENTION

In one broad embodiment, there is provided a wellhead seal device for sealing an annular space formed between an outer tubular member and an inner tubular member, such as a casing head and a casing. The wellhead seal device includes an annular metal sealing sleeve having a lower portion and an upper portion. The upper portion forms a neck portion extending upwardly from the lower portion. The lower portion is adapted to be supported in the annular space. The neck portion has an inner surface adapted to be spaced from the inner tubular member to form an inner sealing annulus. A first metal seal ring is provided having an outer conical surface and being adapted to fit around the inner tubular member within the inner sealing annulus supported by the lower portion adjacent the inner tubular member. A first wedge ring is provided which is adapted to fit around the inner tubular member above the first metal seal ring and having an inner cam surface to engage the conical surface of the first metal seal ring within the inner sealing annulus. A first retaining ring is included and is adapted to be retained in and to close the inner sealing annulus around the inner tubular member above the first wedge ring. The first retaining ring forms a plurality of first vertical threaded ports extending there through for alignment with the first wedge ring. A plurality of first threaded seal energizing members is provided, each being adapted to be threaded through the first vertical threaded ports to push downwardly on the first wedge ring such that the first metal seal ring is compressed radially inwardly to form an inner metal seal to the inner tubular member and thus seal the inner sealing annulus.

The neck portion of the annular metal sealing sleeve may be formed with an outer surface adapted to be spaced from the outer tubular member to form an outer sealing annulus to seal to the inner wall of the outer tubular member. A second metal seal ring is provided with an inner conical surface and adapted to fit around the neck portion within the outer sealing annulus supported by the lower portion adjacent the outer tubular member. A second wedge ring is provided, adapted to fit around the neck portion above the second metal seal ring and having an outer cam surface to engage the conical surface of the second metal seal ring within the outer sealing annulus. A second retaining ring is provided, adapted to be retained in and to close the outer sealing annulus around the neck portion above the first wedge ring. The second retaining ring forms a plurality of second vertical threaded ports extending there through for alignment with the second wedge ring. A plurality of second threaded seal energizing members adapted to be threaded through the second vertical threaded ports is included to push downwardly on the second wedge ring such that the second metal seal ring is compressed radially inwardly to form an outer metal seal to the outer tubular member and thus seal the outer sealing annulus.

The wellhead seal device may be provided to seal the annular space formed between a central bore of vertically aligned upper and lower wellhead members and a rough casing. For example, the upper wellhead member may be a tubing head, and the lower wellhead member may be a casing head. However, the seal device might be accommodated in other wellhead members. The seal device has the advantage of providing, at its lower sealing portion, a primary seal to the rough casing, and a seal to the central bore of the lower wellhead member (ex. casing head), while providing at its upper sealing portion, an external metal seal to the central bore of the upper wellhead member (ex. tubing head), and an internal, secondary metal seal to the rough casing. The seal device includes an annular metal sealing sleeve configured to provide elastomeric or other seals at its lower sealing portion. The upper sealing portion of the annular metal sealing sleeve is configured to allow a secondary metal seal to the rough casing to be energized from above, with a downward force, prior to installing the upper wellhead member. This allows the wellhead seal device to be used in a wellhead with a threaded union between the lower and upper wellhead members (ex. casing head and the tubing head).

The outer surface of the casing, which is formed by rolling, is a rough un-finished surface, with large diametric tolerance. Thus, it takes a large force to energize a seal to this casing surface. However, the central bore of the upper and lower wellhead members typically have machine finished surfaces and tight tolerances, so seals to these surfaces require less force to energize. In one embodiment of the wellhead seal device, the primary and secondary seals to the rough casing are separated from the seals to the finished surfaces of the upper and lower wellhead members. As well, the primary and the secondary seals to the casing are both made by separate surfaces of the one seal device. By separating the seals in the manner, and by configuring the seal device such that the primary and secondary seals to the rough casing are energized from above, without the upper wellhead member yet in place, for example using vertical threaded seal energizing members, sufficient force can be applied to energize a secondary metal seal to the rough casing. A threaded connection between the upper and lower wellhead members can thereafter be made without concern for the primary and secondary seals to the rough casing. The seal device may alternatively be used with flanged or other wellhead connections, but it has the advantage of being able to form a secondary metal seal to the casing in a wellhead which uses a threaded connection.

Broadly stated, there is provided a wellhead seal device for sealing the annular space formed in a central bore extending through vertically aligned upper and lower wellhead members adjacent the rough outer wall of a tubular casing, the casing extending through the lower wellhead member and having an upper end in the upper wellhead member. The wellhead seal device includes an annular metal sealing sleeve having an upper portion integral with a lower portion. The lower portion has an inner bore adapted to provide an inner seal to the casing, and an outer surface adapted to provide an outer seal to the lower wellhead member. The upper portion is configured to extend upwardly from the lower portion into the central bore of the upper wellhead member. An outer tapered surface on the upper portion is adapted to form an external metal seal to a conical central bore section at a lower end of the upper wellhead member. An inner surface of the upper portion is adapted to be spaced from the casing in the upper wellhead member to form a sealing annulus. A metal seal ring having an outer conical surface is adapted to fit around the casing within the sealing annulus supported by the lower portion adjacent the casing. A wedge ring, adapted to fit around the casing above the metal seal ring, has an inner cam surface to engage the outer conical surface of the metal seal ring within the sealing annulus. A retaining ring is adapted to be retained in and to close the sealing annulus of the upper portion around the casing above the wedge ring. The retaining ring forms a plurality of vertical threaded ports extending there through for alignment with the wedge ring. A plurality of threaded seal energizing members are adapted to be threaded through the threaded ports to push downwardly on the wedge ring such that the metal seal ring is compressed radially inwardly to form an internal metal seal to the casing and thus seal the sealing annulus. The downward action on the wedge ring also transfers downward force to the lower portion to energize the inner and outer seals.

Also provided is a wellhead assembly including an upper wellhead member vertically aligned and connected above a lower wellhead member and forming a central bore to accommodate a tubular casing extending through the lower wellhead member and ending with an upper end in the upper wellhead member, such that an annular space is formed between the central bore of the upper and lower wellhead members and the outer wall of the casing. The wellhead assembly further includes one of the above-described wellhead seal devices positioned in sealing relationship in the annular space and providing seals to the central bore in each of the upper and lower wellhead members and seals to the outer wall of the casing in each of the upper and lower wellhead members.

There is also provided a method of sealing an annular space formed between an inner tubular member and an outer tubular member. The method includes:

providing an annular metal sealing sleeve having a lower portion and an upper portion, the upper portion forming a neck portion extending upwardly from the lower portion, the lower portion being adapted to be vertically supported in the annular space, and the neck portion having an inner surface adapted to be spaced from the inner tubular member to form an inner sealing annulus;

installing the annular metal sealing sleeve in a vertically supported manner in the annular space;

installing a first metal seal ring in a supported manner in the inner sealing annulus; and applying a downward force within the inner sealing annulus such that the first metal seal ring is compressed radially inwardly to form an inner metal seal to the inner tubular member.

Broadly stated, there is also provided a method of sealing an annular space formed in a central bore extending through vertically aligned upper and lower wellhead members adjacent an outer wall of a tubular casing, the casing extending through the lower wellhead member and having an upper end in the upper wellhead member. The method includes:

a. providing an annular metal sealing sleeve having an upper sealing portion and a lower sealing portion, the lower sealing portion having an inner bore adapted to form an inner seal to the casing and an outer surface adapted to form an outer seal to the central bore of the lower wellhead member, and the upper sealing portion having an outer tapered surface adapted to form an external metal seal to a conical central bore section at a lower end of the upper wellhead member, and an inner surface adapted to be spaced from the casing in the upper wellhead member to form a sealing annulus to accommodate an internal metal seal to the casing;

b. installing the metal sealing sleeve in the annular space of the lower wellhead member;

c. installing a metal seal ring in a supported manner in the sealing annulus;

d. applying a downward force within the sealing annulus such that the metal seal ring is compressed radially inwardly to form the internal metal seal to the casing, and to energize the inner and outer seals of the lower sealing portion; and e. connecting the upper wellhead member above the lower wellhead member such that the outer tapered surface of the upper sealing portion forms the external metal seal to the conical central bore section of the upper wellhead member.

Also provided is a method of sealing an annular space formed in a central bore extending through vertically aligned upper and lower wellhead members adjacent a rough outer wall of a tubular casing, the casing extending through the lower wellhead member and having an upper end in the upper wellhead member. The method includes:

a. installing one of the above-described annular metal sealing sleeves in the annular space of the lower wellhead member;

b. installing the metal seal ring in the sealing annulus such that it is supported against downward movement by the lower portion of the metal sealing sleeve;

c. installing the wedge ring above the metal seal ring;

d. installing the retaining ring in the upper portion of the metal sealing sleeve;

e. threading the threaded seal energizing members into the threaded ports in the retaining ring to press downwardly on the wedge ring and to compress the metal seal ring radially inwardly to form the internal metal seal to the casing and thus seal the sealing annulus, and to also transfer downward force to the lower portion to energize the inner and outer seals; and f. connecting the upper wellhead member above the lower wellhead member such that the outer tapered surface of the upper portion of the metal sealing sleeve forms the external metal seal to the conical central bore section at the lower end of the upper wellhead member.

The wellhead seal device has the advantage of allowing for testing each of the seals formed by the seal device, for example through one or more test ports formed through the tubing head and through the metal sealing sleeve to communicate with the seals.

DETAILED DESCRIPTION OF THE INVENTION

Figure 1:
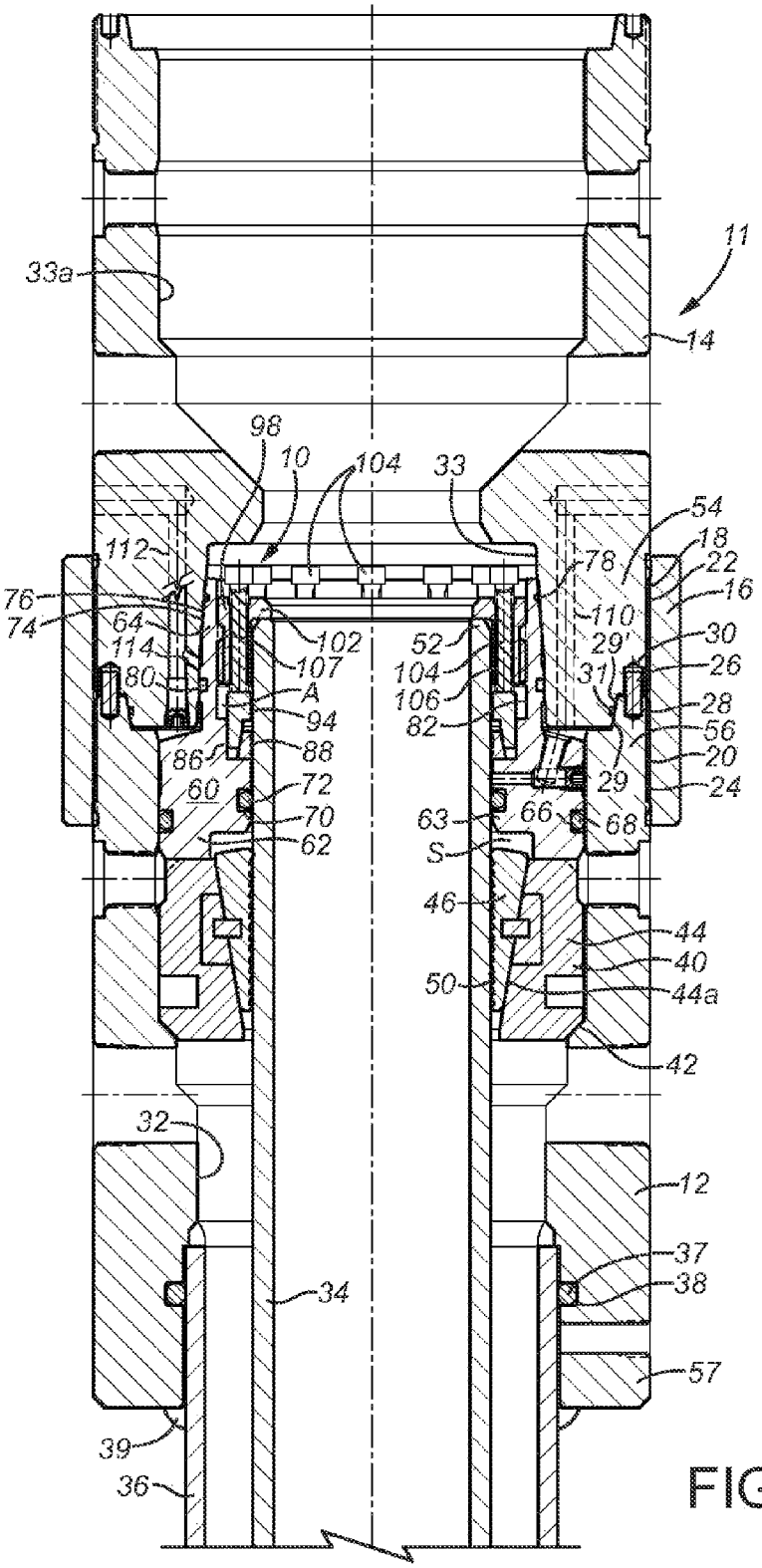
FIG. 1 is an sectional view of a wellhead assembly with the wellhead seal device sealing the annular space formed at the central bore of a casing head and a tubing head to a rough outer wall of a casing.
Figure 2:
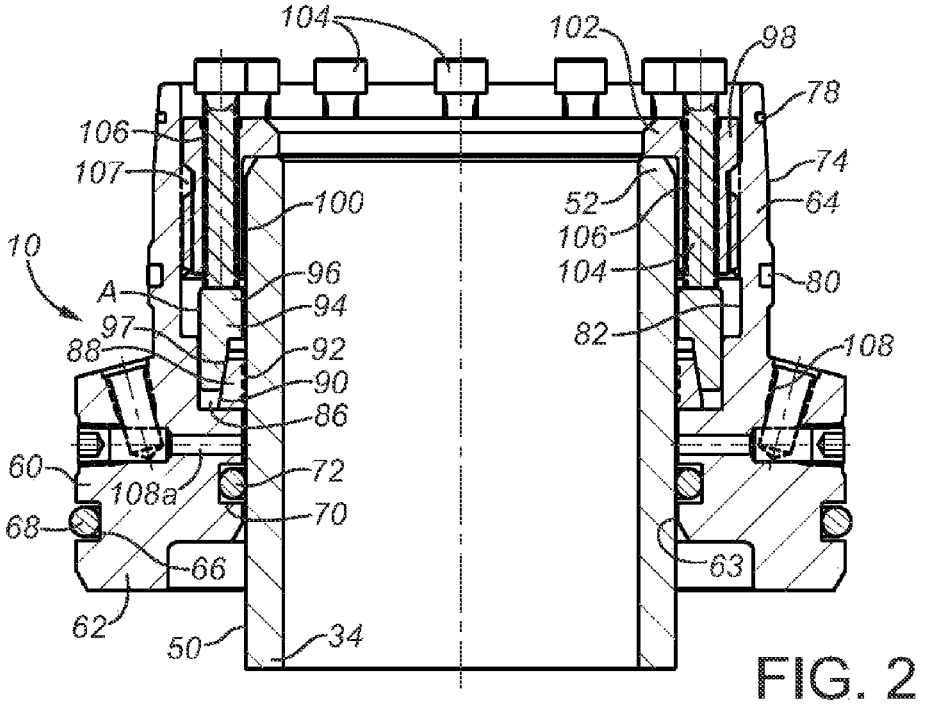
FIG. 2 is a sectional view of the wellhead seal device of FIG. 1, showing the primary (lower) seal and secondary (upper) seal to the rough casing.
Figure 3:
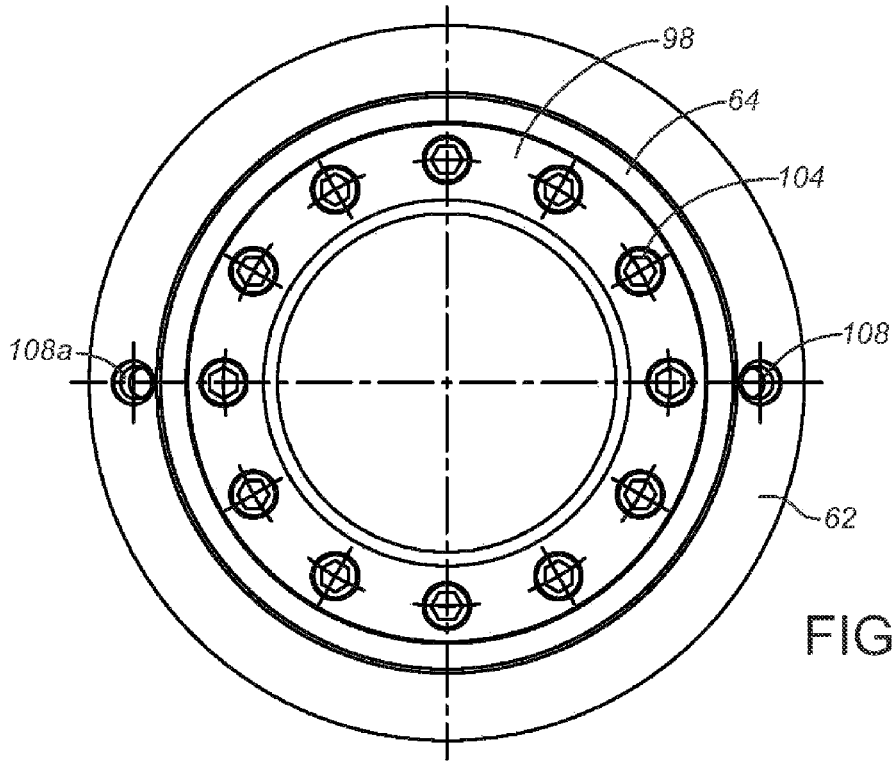
FIG. 3 is a top view of the wellhead seal device of FIG. 2.

Having reference to FIGS. 1-3, one exemplary embodiment of the wellhead seal device 10 is shown in connected and sealing relationship in a wellhead assembly 11. A lower wellhead member, shown as a casing head 12, is connected to an upper wellhead member, shown as a tubing head 14. The connection between the wellhead members 12, 14 is shown as a threaded collar 16, although other known pressure containing wellhead connections may be used, such as other threaded connections, top and bottom bolted flanges, bolted up or down stud connectors, hub connectors or welded connections. The threaded collar 16 is formed with a set of left-hand threads 18 and a set of right-hand threads 20 on its inner surface. Threads 18, 20 provide a threaded connection to the threads 22 on the lower end 54 of the tubing head 14, and to the threads 24 on the upper end 56 of the casing head 12. This type of threaded connection is described in greater detail in United States Published Patent Application 2008/0185156 to Rodgers et al. Alignment pins 26 are located in mating holes 28, 30 in the mating surfaces of the casing head 12 and tubing head 14 respectively, to assist in aligning the heads 12, 14, and to prevent rotation of the heads 12, 14 after forming the connection. The casing and tubing heads 12, 14 may form tapered mating surfaces 29, 29', and a seal 31 is located at these tapered surfaces. The seal 31 may be a elastomeric or metal seal, or other type of seal, depending on the wellhead application.

When the casing head 12 and the tubing head 14 are connected together in a vertically aligned manner, a central bore 32 extends through the casing head 12 and a central bore 33 extends through the tubing head 14. The central bores 32, 33 communicate with each other to accommodate a tubular casing 34 (i.e., an inner tubular member). The bores 32, 33 are profiled by machining to accommodate or support conventional components, guides, landing shoulders and the like, as is known in the industry. The upper portion of the central bore 33 of the tubing head 14 is shown formed with a profile **33*a* to support a conventional tubing hanger. The central bore 32 of the casing head 12 is shown profiled to support a casing hanger, such as a slip assembly 40. The casing head 12 is sealed at its lower end 57 to a surface casing 36, for example with an O-ring 37 held in a circumferential groove 38. Lower external welds 39 may be included between the casing head 12 and the surface casing 36. The slip assembly 40 is supported on landing shoulder 42 in the central bore 32 of the casing head 12. The slip assembly 40 includes an outer slip housing 44 supported on landing shoulder 42, and forming a tapered bowl 44*a* at its inner bore. A plurality of wedge shaped segmented slips 46 are supported by the slip housing 44. The slips 46 are formed with inwardly projecting teeth 48 on their inner gripping surface to grip the rough outer wall 50 of the casing 34, thus enabling the slip assembly 40 to engage and suspend the casing 34. The casing 34 extends upwardly into the central bore 33 of the tubing head 14 such that the upper end 52 of the casing 34 is located above the lower end 54 of the tubing head 14. An annular space S is formed between the communicating central bores 32, 33 and an upper portion of the outer wall 50 of the casing 34. This annular space S is sealed by the seal device 10**, as described more fully below.

In the embodiment of FIGS. 1-3, the seal device 10 includes an annular metal sealing sleeve 60 having a lower sealing portion 62 and an integral upper sealing portion 64. The sealing sleeve 60 may be formed from high strength metals such as a high alloy steel. The lower portion 62 is formed with a central bore 63, and is sized to have a close fitting relationship in the annular space S between the central bore 32 and the casing 34 within the casing head 12. A circumferential groove 66 is formed on the outer surface of the lower portion 62 and includes an elastomeric seal such as an O-ring 68 to provide an outer seal to the central bore 32 within the casing head 12. A circumferential groove 70 formed on the inner surface of the lower portion 62 includes an elastomeric seal such as an O-ring 72 to provide an inner seal to the outer wall 50 of the casing 34. O-ring 72 thus serves as a primary seal to the casing 34.

The upper portion 64 of the sealing sleeve 60 extends upwardly from the lower portion 62, and forms an outer tapered surface 74 adapted to form an external metal seal to the conical central bore section 76 at the lower end of the central bore 33 of the tubing head 14. The outer tapered surface 74 is slightly larger diametrically than the diameter of the conical central bore section 76 of the tubing head 14 so as to form an interference fit when the tubing head 14 is lowered over the seal device 10. Spaced apart circumferential grooves 78, 80 are formed above and below the tapered surface 74 of the upper portion 64. These grooves 78, 80 increase the resiliency of the upper portion 64, allowing it to flex slightly inwardly to form the metal seal when the tubing head 14 is connected above the casing head 12. The grooves 78, 80 also allow for seals, for example O-rings (not shown) to be included on this external metal sealing surface.

The inner surface 82 of the upper portion 64 is formed recessed relative to the central bore 63 of the lower portion 62, such that the inner surface 82 is spaced from the outer wall 50 of the casing 34. This forms a sealing annulus A between the upper portion 64 and the casing 34. The sealing annulus A accommodates an internal metal seal to the rough outer wall 50 of the casing 34 within the tubing head 14, as described below. At the base of the sealing annulus A, above the lower portion 62, a reduced diameter section 86, adjacent the casing 34 is preferably formed to accommodate the internal metal seal to the casing 34.

A metal seal ring 88 is installed in the reduced diameter section 86 so as to be supported against downward vertical movement by the lower portion 62 of the metal sealing sleeve 60. The metal seal ring 88 is formed with an outer conical surface 90. The inner surface (i.e., inner bore) of the metal seal ring 88 is formed with inwardly projecting ribs, ridges, serrations or ribs (i.e., projections) 92 to seal to the casing 34. A wedge ring 94 is positioned in the reduced diameter section 86 around the casing 34 above the metal seal ring 88. The wedge ring 94 has an upper portion which forms a lip 96 which extends inwardly to the casing 34 to form a central bore adjacent the outer wall 50 of the casing 34. The lower portion of the wedge ring 94 is spaced from the metal seal ring 88 and provides a mating cam surface 97 at its inner surface to slide over the outer conical surface 90 of the metal seal ring 88. The metal seal ring 88 and the lower portion of the wedge ring 94 have a combined radial thickness which is slightly oversized compared to the radial dimension of the reduced diameter section 86. In this manner, downward force applied to the upper surface of the wedge ring 94 transfers a sliding cam force on the metal seal ring 88, causing the metal seal ring 88 to be radially compressed inwardly to form a metal seal to the outer wall 50 of the casing 34.

A retaining ring 98 is retained within the upper portion 64 of the sealing sleeve 60. The retaining ring 98 has multiple functions, including closing the sealing annulus A above the metal seal ring 88, supporting the upper portion 64 of the sealing sleeve 60 (ex. to form the external seal to the tubing head 14, and to withstand high internal pressure without collapse), and providing a means to energize the metal seal ring 88 prior to installing the tubing head 14. The inner surface 82 of the upper portion 64 of the metal sealing sleeve 60 is preferably threaded to receive and retain a retaining ring 98 within the sealing annulus A. The retaining ring 98 is threaded on its outer peripheral surface. The retaining ring 98 is formed with a central bore 100 to accommodate the casing 34. An upper inwardly extending lip 102 on the retaining ring 98 may be included to extend over and to protect the upper end 52 of the casing 34 once the retaining ring 98 is threaded in place. A plurality of threaded cap screws 104 (or other threaded seal energizing members such as threaded screws or bolts/nuts) extend through vertical threaded ports 106 and are aligned with the wedge ring 94, such that downward threading of the cap screws 104 forces the wedge ring 94 downwardly to energize the metal seal ring 88. The retaining ring 98 preferably includes a circumferential groove 107 at its outer surface to serve as a relief groove on its threaded outer surface.

The lower portion 62 is preferably formed with one or more test ports 108, **108*a* extending there through to a location above the primary seal 72. In the illustrated embodiment, two communicating test ports 108, 108*a* are shown, which allow for bleeding out during testing. These test ports 108, 108*a* allow for testing of the seals to the casing 34 (i.e., seals 72 and 88), before installing the tubing head 14. Thus, the seal device 10 allows one to check the integrity of the seals to the rough outer surface of the casing 34**, before installing further wellhead members.

One or more test ports 110, 112 are formed through the tubing head 14 as shown in FIG. 1 to allow testing of the seals provided by the seal device 10, and to test the wellhead connection seals. One or both of the test ports 110, 112 extend through to the metal seal surface between grooves 78, 80 to test the metal seal to the tubing head 14. In FIG. 1, test port 112 includes branch port 114 for this purpose. This test location also confirms the continued integrity of the seals 72, 88 to the casing 34. The test ports 110, 112 extend through to the central bore 33 of the tubing head 14 below the external metal seal to the tubing head 14. In FIG. 1, the test ports 110, 112 end adjacent the lower portion 62 of the seal device 10, in a manner to allow testing of the wellhead connections, including seal 31 between the tubing head 14 and the casing head 12, and seal 68 between the seal device 10 and the central bore 32 of the casing head 12.

It will be understood that the metal sealing sleeve 60, retaining ring 98, wedge ring 94 and metal seal ring 88 are each formed for tight fitting relationships with each other and with the casing 34 to fully close and seal the sealing annulus A along the outer wall 50 of the casing 34. These four components 60, 98, 94, 88, when fully installed and connected together around the casing 34, provide a single wellhead seal device which forms both the primary seal and the secondary seal to the rough outer wall of the casing 34.

It will be apparent from the above description that there is provided a method in which the seal device 10 is installed in the casing head 12 prior to connecting the tubing head 14 with the threaded collar 16. In this way, the secondary seal to the casing 34 can be formed as a reliable metal seal with a sufficient seal energizing force being supplied through threaded seal energizing members, such as the cap screws 104. The tubing head 14 is thereafter connected to the casing head 12 using a threaded connection, such as the threaded collar 16, without damaging the seals to the casing 34. Alternate connections between the casing and tubing heads 12, 14 may be used, but the seal device 10 has the advantage of allowing for a secondary metal seal to be made to the casing in a wellhead which uses a threaded connection between the heads 12, 14.

Figure 4:
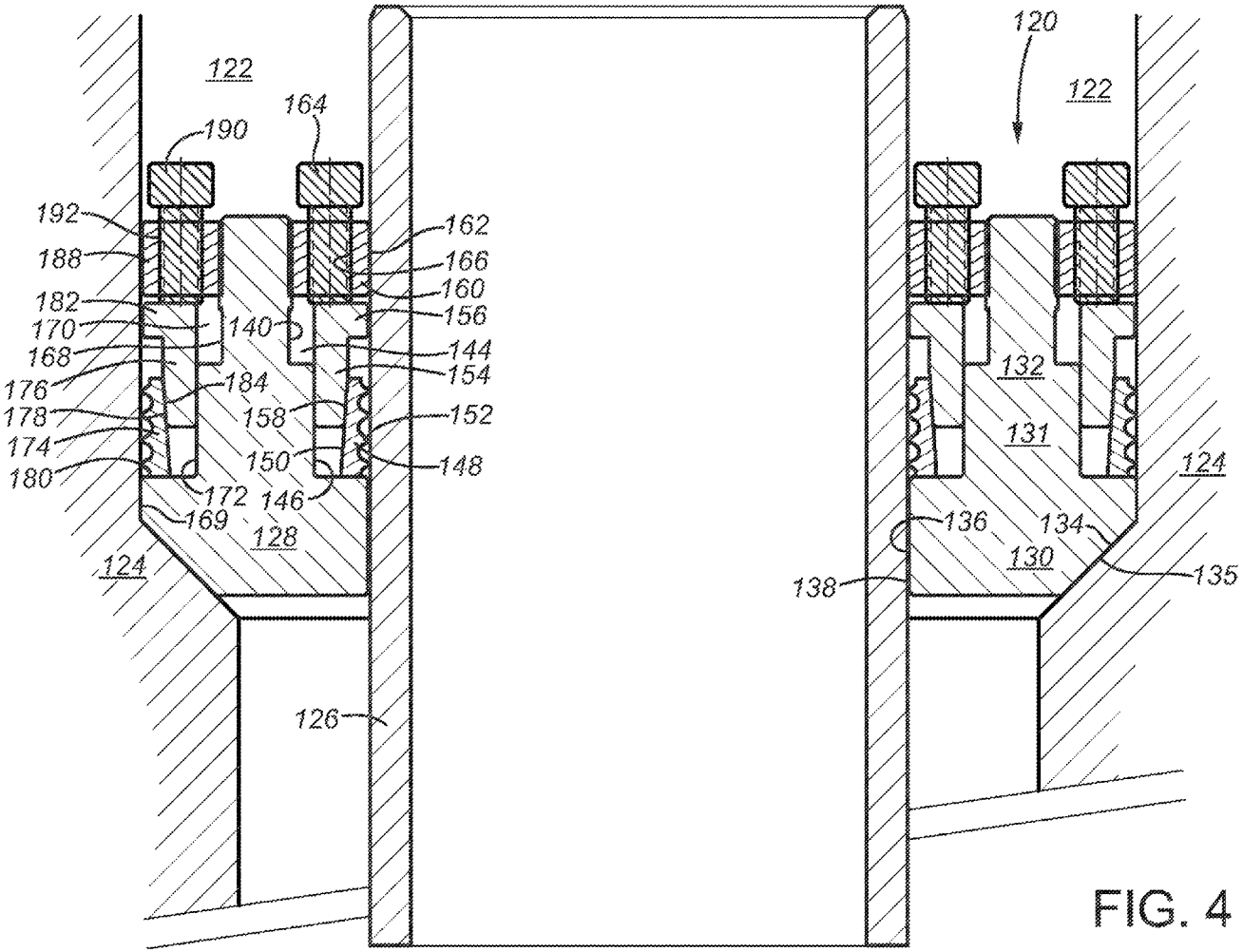
FIG. 4 is a sectional view of a wellhead assembly and a wellhead seal device sealing the annular space formed between an inner tubular member and an outer tubular member.

FIG. 4 shows an embodiment of a wellhead seal device 120 for sealing the annular space 122 formed between an outer tubular member 124 (for example a casing head) and an inner tubular member 126 (for example a casing). One or both of the inner seal to the inner tubular member 126 and the outer seal to the outer tubular member 124 may be formed as a metal seal. In FIG. 4, both the inner and outer seals are shown as metal seals. It will be understood that one of the seals, for example the outer seal to the outer tubular member 124, might be alternatively formed as a non-metal seal. In that alternate embodiment, an elastomeric seal such as an O-ring might be held in a circumferential groove formed in the outer periphery of the seal device 120.

In FIG. 4, the seal device 120 is shown to include an annular metal sealing sleeve 128 having a lower portion 130 and an upper portion 131 which forms a neck portion 132 extending upwardly from the lower portion 130. The lower portion 130 is shown to be formed with an outer tapered shoulder 134 to vertically support the sealing sleeve 128 on a similarly shaped inwardly projecting landing shoulder 135 formed by the outer tubular member 124. Other embodiments to vertically support the sealing sleeve 128 within the annular space 122 may be used. The lower portion 130 has an central bore 136 to accommodate the outer wall 138 of the inner tubular member 126. The neck portion 132 may be integral with the lower portion 130. The neck portion 132 has an inner surface 140 which is recessed relative to the central bore 136 of the lower portion 130 such that the inner surface 140 is spaced from the outer wall 138 of the inner tubular member 126 to form an inner sealing annulus 144. The inner sealing annulus 144 accommodates an inner metal seal to the inner tubular member 126 as described below. At the base of the inner sealing annulus 144, above the lower portion 130, a reduced diameter section 146, adjacent the inner tubular member 126 is formed. A first metal seal ring 148 is installed in the reduced diameter section 146 so as to be supported against downward vertical movement by the lower portion 130. The first metal seal ring 148 is formed with an outer conical surface 150. The inner surface (bore) of the first metal seal ring 148 is formed with inwardly projecting ribs, ridges, serrations or ribs (projections) 152 to seal to the inner tubular member 126. A first wedge ring 154 is positioned in the reduced diameter section 146 around the inner tubular member 126 above the first metal seal ring 148. The first wedge ring 154 has an upper portion which forms a lip 156 which extends inwardly to the inner tubular member 126 to form a central bore adjacent the outer wall 138 of the inner tubular member 126. The lower portion of the first wedge ring 154 is spaced from the first metal seal ring 148 and provides a mating cam surface 158 at its inner surface to slide over the outer conical surface 150 of the first metal seal ring 148. The first metal seal ring 148 and the lower portion of the wedge ring 154 have a combined radial thickness which is slightly oversized compared to the radial dimension of the reduced diameter section 146. In this manner, downward force applied to the upper surface of the first wedge ring 154 transfers a sliding cam force on the first metal seal ring 148, causing the first metal seal ring 148 to be radially compressed inwardly to form the inner metal seal to the outer wall 138 of the inner tubular member 126.

A first retaining ring 160 is retained within the neck portion 132 to close the inner sealing annulus 144 above the first metal sealing ring 148. The inner surface 140 of the neck portion 132 is preferably threaded to receive and retain the first retaining ring 160 within the inner sealing annulus 144. The first retaining ring 160 is threaded on its outer peripheral surface. The first retaining ring 160 is formed with a central bore 162 to accommodate the inner tubular member 126. A plurality of first threaded cap screws 164 (or other threaded seal energizing members such as bolts/nuts) extend through first vertical threaded ports 166 in the first retaining ring 160 and are aligned with the first wedge ring 154, such that downward threading of the first cap screws 164 forces the first wedge ring 154 downwardly to energize the first metal seal ring 148, and thus seal the inner sealing annulus 144.

The neck portion 132 is preferably formed with an outer surface 168 which is recessed from the inner wall 169 of the outer tubular member 124 to form an outer sealing annulus 170. A reduced radius section 172 is formed at the base of the outer sealing annulus 170. A second metal seal ring 174 and a second wedge ring 176 are accommodated in the reduced radius section 172. The second metal seal ring 174 has an inner conical surface 178, and projections 180 are formed on the outer peripheral surface. The second wedge ring 176 has an upper portion forming a lip 182 which extends outwardly to the outer tubular member 124. The lower portion of the second wedge ring 176 is spaced from the second metal seal ring 174 and provides a mating cam surface 184 at its outer surface to slide over the inner conical surface 178 of the second metal seal ring 174. The second metal seal ring 174 and the lower portion of the second wedge ring 176 have a combined radial thickness which is slightly oversized compared to the radial dimension of the reduced diameter section 172. In this manner, downward force applied to the upper surface of the second wedge ring 176 transfers a sliding cam force on the second metal seal ring 174, causing the second metal seal ring 174 to be radially compressed outwardly to form the outer metal seal to the inner wall 169 of the outer tubular member 124.

A second retaining ring 188 is retained within the neck portion 132 to close the outer sealing annulus 170 above the second metal sealing ring 174. The outer surface 168 of the neck portion 132 is preferably threaded to receive and retain the second retaining ring 188 within the outer sealing annulus 170. The second retaining ring 188 is threaded on its inner surface. The second retaining ring 188 is formed with an outer peripheral surface to accommodate the outer tubular member 124. A plurality of second threaded cap screws 190 (or other threaded seal energizing members such as bolts/nuts) extend through second vertical threaded ports 192 and are aligned with the second wedge ring 176, such that downward threading of the second cap screws 190 forces the second wedge ring 176 downwardly to energize the second metal seal ring 174, and thus seal the outer sealing annulus 170.

This further embodiment provides a method of sealing the annular space 122 formed between the inner tubular member 126 and the outer tubular member 124, with an inner metal seal to the inner tubular member 126. The annular metal sealing sleeve 128 is installed in a vertically supported manner in the annular space 122, for example on the landing shoulder 135. The sealing sleeve 128 may be alternatively supported, for example as shown in FIG. 1 by a casing hanger such as a slip assembly. The first metal seal ring 148 is installed in a supported manner in the inner sealing annulus 144, such as by the lower portion 130. A downward force is applied within the inner sealing annulus 144, such as with first cap screws 164, such that the first metal seal ring 148 is compressed radially inwardly to form an inner metal seal to the inner tubular member 126. This embodiment also provides a method of sealing the annular space 122 with an outer metal seal to the outer tubular member 124. The second metal seal ring 174 is installed in a supported manner, for example by the lower portion 130, in the outer sealing annulus 170. A downward force is applied within the outer sealing annulus 170, for example with the second cap screws 190, such that the second metal seal ring 174 is compressed radially outwardly to form an outer metal seal to the outer tubular member 124.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

We claim:

1. A wellhead seal device for sealing in an annular space formed between an outer tubular member and an inner tubular member, the wellhead seal device comprising:

an annular metal sealing sleeve having a lower portion and an upper portion, the upper portion forming a neck portion extending upwardly from the lower portion, the lower portion being adapted to be supported in the annular space, the neck portion having an inner surface adapted to be spaced from the inner tubular member to form an inner sealing annulus;

a first metal seal ring having an outer conical surface and being adapted to fit around the inner tubular member within the inner sealing annulus supported by the lower portion adjacent the inner tubular member;

a first wedge ring adapted to fit around the inner tubular member above the first metal seal ring and having an inner cam surface to engage the conical surface of the first metal seal ring within the inner sealing annulus;

a first retaining ring adapted to be retained in and to close the inner sealing annulus around the inner tubular member above the first wedge ring, the first retaining ring forming a plurality of first vertical threaded ports extending there through for alignment with the first wedge ring; and a plurality of first threaded seal energizing members adapted to be threaded through the first vertical threaded ports to push downwardly on the first wedge ring such that the first metal seal ring is compressed radially inwardly to form an inner metal seal to the inner tubular member and thus seal the inner sealing annulus.

2. The wellhead seal device of claim 1 wherein the neck portion has an outer surface adapted to be spaced from the outer tubular member to form an outer sealing annulus, and wherein the wellhead seal device further comprises:

a second metal seal ring having an inner conical surface and being adapted to fit around the neck portion within the outer sealing annulus supported by the lower portion adjacent the outer tubular member;

a second wedge ring adapted to fit around the neck portion above the second metal seal ring and having an outer cam surface to engage the conical surface of the second metal seal ring within the outer sealing annulus;

a second retaining ring adapted to be retained in and to close the outer sealing annulus around the neck portion above the first wedge ring, the second retaining ring forming a plurality of second vertical threaded ports extending there through for alignment with the second wedge ring; and a plurality of second threaded seal energizing members adapted to be threaded through the second vertical threaded ports to push downwardly on the second wedge ring such that the second metal seal ring is compressed radially inwardly to form an outer metal seal to the outer tubular member and thus seal the outer sealing annulus.

3. A wellhead seal device for sealing in an annular space formed in a central bore extending through vertically aligned upper and lower wellhead members adjacent the rough outer wall of a tubular casing such that the casing extends through the lower wellhead member and has an upper end in the upper wellhead member, the wellhead seal device comprising:

an annular metal sealing sleeve having an upper portion integral with a lower portion;

the lower portion having an inner bore adapted to provide an inner seal to the casing and an outer surface adapted to provide an outer seal to the central bore of the lower wellhead member;

the upper portion being configured to extend upwardly from the lower portion into the central bore of the upper wellhead member, the upper portion having an outer tapered surface adapted to form an external metal seal to a conical central bore section at a lower end of the upper wellhead member, and an inner surface adapted to be spaced from the casing in the upper wellhead member to form a sealing annulus;

a metal seal ring having an outer conical surface and being adapted to fit around the casing within the sealing annulus supported by the lower portion adjacent the casing;

a wedge ring adapted to fit around the casing above the metal seal ring and having an inner cam surface to engage the conical surface of the metal seal ring within the sealing annulus;

a retaining ring adapted to be retained in and to close the sealing annulus of the upper portion around the casing above the wedge ring, the retaining ring forming a plurality of vertical threaded ports extending there through for alignment with the wedge ring; and a plurality of threaded seal energizing members adapted to be threaded through the threaded ports to push downwardly on the wedge ring such that the metal seal ring is compressed radially inwardly to form an internal metal seal to the casing and thus seal the sealing annulus, and to also transfer downward force to the lower portion to energize the inner and outer seals.

4. The wellhead seal device of claim 3, wherein the upper portion is adapted to form a reduced diameter section in the sealing annulus above the lower portion, wherein the metal seal ring is formed with projections at its inner surface; and wherein the metal seal ring and wedge ring are adapted to seal the reduced diameter section against the casing.

5. The wellhead seal device of claim 4, wherein the upper portion is threaded at the inner surface, and wherein the retaining ring is threaded at its outer surface to be retained by the upper portion within the sealing annulus.

6. The wellhead seal device of claim 5, wherein the plurality of threaded seal energizing members are threaded screws.

7. The wellhead seal device of claim 6, wherein the lower portion is adapted to be seated or supported in the annular space in the lower wellhead member.

8. The wellhead seal device of claim 6, wherein the lower portion is adapted to be supported above a slip assembly in the lower wellhead member.

9. The wellhead seal device of claim 8, wherein the lower portion is formed to provide a first elastomeric seal to provide the inner seal to the casing and a second elastomeric seal to provide the outer seal to the lower wellhead member.

10. The wellhead seal device of claim 9, wherein the first elastomeric seal is formed by an O-ring held in a first circumferential groove formed on the inner surface of the lower portion and the second elastomeric seal is formed by an O-ring held in a second circumferential groove formed on the outer surface of the lower portion.

11. The wellhead seal device of claim 9, wherein the outer surface of the upper portion is formed with spaced apart circumferential grooves adapted to provide one or more additional seals to the conical central bore section of the upper wellhead member.

12. The wellhead seal device of claim 10, wherein the outer surface of the upper portion is formed with spaced apart circumferential grooves adapted to provide one or more seals to the conical central bore section of the upper wellhead member.

13. The wellhead seal device of claim 12, wherein the metal sealing sleeve is formed with one or more test ports extending through the lower portion above the inner seal to the casing.

14. A wellhead assembly comprising:

an upper wellhead member adapted to be vertically aligned and connected above a lower wellhead member, the upper and lower wellhead members forming a central bore to accommodate a tubular casing extending through the lower wellhead member and ending with an upper end in the upper wellhead member, such that an annular space is formed between the central bore of the upper and lower wellhead members and an outer wall of the casing; and the wellhead seal device of claim 3 positioned in sealing relationship in the annular space and providing seals to the central bore in each of the upper and lower wellhead members and seals to the outer wall of the casing in each of the upper and lower wellhead members.

15. The wellhead assembly of claim 14, wherein the upper wellhead member is a tubing head and the lower wellhead member is a casing head, and wherein the lower end of the tubing head and the upper end of the casing head are adapted to be connected together with a threaded connection.

16. The wellhead assembly of claim 15, wherein the casing head supports a slip assembly to the casing, and wherein the metal sealing sleeve is supported above the slip assembly.

17. The wellhead assembly of claim 16, wherein the threaded connection comprises a threaded collar connecting to a threaded outer surface of the tubing head and to a threaded outer surface of the casing head.

18. The wellhead assembly of claim 17, wherein the tubing head and the metal sealing sleeve are formed with one or more communicating test ports adapted to allow testing of the seals to the casing, the seal at the central bore of the tubing head and the seal at the central bore of the casing head.

19. A method of sealing in an annular space formed between an inner tubular member and an outer tubular member, comprising:

providing an annular metal sealing sleeve having a lower portion and an upper portion, the upper portion forming a neck portion extending upwardly from the lower portion, the lower portion being adapted to be vertically supported in the annular space, and the neck portion having an inner surface adapted to be spaced from the inner tubular member to form an inner sealing annulus;

installing the annular metal sealing sleeve in a vertically supported manner in the annular space;

installing a first metal seal ring in a supported manner in the inner sealing annulus, the first metal seal ring having an outer conical surface;

installing a first wedge ring around the inner tubular member above the first metal seal ring such that an inner cam surface of the first wedge ring engages the outer conical surface of the first metal seal ring within the inner sealing annulus; and applying a downward force on the first wedge ring within the inner sealing annulus such that the first metal seal ring is compressed radially inwardly to form an inner metal seal to the inner tubular member and thus seal the inner sealing annulus.

20. The method of claim 19, wherein the neck portion has an outer surface adapted to be spaced from the outer tubular member to form an outer sealing annulus, and wherein the method further comprises:

installing a second metal seal ring around the neck portion in a supported manner in the outer sealing annulus the second metal seal ring having an inner conical surface;

installing a second wedge ring around the neck portion in the outer sealing annulus above the second metal seal ring such that an outer cam surface of the second wedge ring engages the inner conical surface of the second metal seal ring within the outer sealing annulus; and applying a downward force on the second wedge ring within the outer sealing annulus such that the second metal seal ring is compressed radially outwardly to form an outer metal seal to the outer tubular member and thus seal the outer sealing annulus.

21. A method of sealing in an annular space formed in a central bore extending through vertically aligned upper and lower wellhead members adjacent an outer wall of a tubular casing, the casing extending through the lower wellhead member and having an upper end in the upper wellhead member, the method comprising:

providing an annular metal sealing sleeve having an upper sealing portion and a lower sealing portion, the lower sealing portion having an inner bore adapted to form an inner seal to the casing and an outer surface adapted to form an outer seal to the central bore of the lower wellhead member, and the upper sealing portion having an outer tapered surface adapted to form an external metal seal to a conical central bore section at a lower end of the upper wellhead member, and an inner surface adapted to be spaced from the casing in the upper wellhead member to form a sealing annulus to accommodate an internal metal seal to the casing;

installing the metal sealing sleeve in the annular space of the lower wellhead member;

installing a metal seal ring in a supported manner in the sealing annulus;

applying a downward force within the sealing annulus such that the metal seal ring is compressed radially inwardly to form the internal metal seal to the casing and thus seal the sealing annulus, and to energize the inner and outer seals of the lower sealing portion; and connecting the upper wellhead member above the lower wellhead member such that the outer tapered surface of the upper sealing portion forms the external metal seal to the conical central bore section of the upper wellhead member.

22. A method of sealing in an annular space formed in a central bore extending through vertically aligned upper and lower wellhead members adjacent a rough outer wall of a tubular casing, the casing extending through the lower wellhead member and having an upper end in the upper wellhead member, the method comprising:

installing the metal sealing sleeve of claim 3 in the annular space of lower wellhead member;

installing the metal seal ring in the sealing annulus such that it is supported against downward movement by the lower portion of the metal sealing sleeve;

installing the wedge ring above the metal seal ring;

installing the retaining ring in the upper portion of the metal sealing sleeve;

threading the threaded seal energizing members into the threaded ports in the retaining ring to press downwardly on the wedge ring and to compress the metal seal ring radially inwardly to form the internal metal seal to the casing and thus seal the sealing annulus, and to also transfer downward force to the lower portion to energize the inner and outer seals; and connecting the upper wellhead member above the lower wellhead member such that the outer tapered surface of the upper portion of the metal sealing sleeve forms the external metal seal to the conical central bore section at the lower end of the upper wellhead member.

23. The method of claim 22, further comprising, before connecting the upper wellhead member, testing the metal seal to the casing and the inner seal to the casing through one or more first test ports in the metal sealing sleeve.

24. The method of claim 23, further comprising, after connecting the upper wellhead member, testing the outer metal seal through one or more second test ports formed through the tubing head, and optionally communicating with the one or more first test ports.

* * * * *